United States Patent [19]

Lawson

[11] Patent Number: 4,583,746

[45] Date of Patent: Apr. 22, 1986

[54] METHOD AND APPARATUS FOR SEALING BETWEEN TWO CONCENTRIC MEMBERS

[75] Inventor: John E. Lawson, Houston, Tex.

[73] Assignee: Armco Inc., Middletown, Ohio

[21] Appl. No.: 665,659

[22] Filed: Oct. 26, 1984

Related U.S. Application Data

[63] Continuation of Ser. No. 584,886, Feb. 28, 1985, abandoned, which is a continuation of Ser. No. 446,994, Dec. 6, 1982, abandoned.

[30] Foreign Application Priority Data

Dec. 8, 1981 [GB] United Kingdom ..... 8136936
Sep. 24, 1982 [GB] United Kingdom ..... 8227363

[51] Int. Cl.[4] ..... F16L 33/16
[52] U.S. Cl. ..... 277/1; 277/190
[58] Field of Search ..... 277/1, 31, 190, 191

[56] References Cited

U.S. PATENT DOCUMENTS 3,877,707 4/1975 Stuakari ..... 277/190
4,178,020 6/1980 Dodtera ..... 277/190
4,346,903 6/1982 Heiermann ..... 277/1

*Primary Examiner*—Robert I. Smith
*Attorney, Agent, or Firm*—Roylance, Abrams, Berdo & Goodman

[57] ABSTRACT

Method and apparatus for establishing a seal across the annulus between two concentric rigid members to seal the annulus against large fluid pressures. A specially formed seal ring, advantageously of low carbon steel in the annealed state, is preliminarily inserted into the annular space between two concentrically opposed surfaces, then forced further into that annular space to force the sealing ring, with accompanying plastic deformation of a portion of the ring, into sealing engagement with both of the concentrically opposed surfaces.

15 Claims, 7 Drawing Figures

METHOD AND APPARATUS FOR SEALING BETWEEN TWO CONCENTRIC MEMBERS

RELATED APPLICATIONS

This appliction is a continuation of application Ser. No. 584,886, filed Feb. 29, 1985 and now abandoned, which was a continuation of application Ser. No. 446,994, filed Dec. 6, 1982 and now abandoned. Subject matter disclosed herein is also disclosed in my application Ser. No. 446,995, filed concurrently with application Ser. No. 446,994.

This invention relates to a method and apparatus for providing a fluid-tight seal between two concentric rigid members in order to seal the annulus between the two members against large fluid pressures. While more generally applicable, the invention is especially useful in sealing between concentric well members, as between a wellhead body and a casing hanger or between a wellhead body and a tubing hanger, particularly when such seals must be established remotely at a location under water.

BACKGROUND OF THE INVENTION

There are numerous requirements for sealing the annulus between two stationary concentric rigid members, with such applications usually requiring that the seal be effective against large fluid pressures. One such requirement which is increasingly difficult to satisfy is for sealing between concentric well members, as between a wellhead member and a casing string or between a wellhead member and one or more tubing strings, particularly when the seal is to be established by remote operations at considerable depth under water in an offshore well installation.

Historically, such seals have been established by elastomeric sealing elements, as seen for example in U.S. Pat. No. 3,268,241 to Castor et al, or by using so-called metal lip seals, as in U.S. Pat. No. 3,378,269 to Castor, or by using Laurent seals of the type shown for example in U.S. Pat. No. 2,687,229 to Laurent. The conditions under which such seals must operate have become increasingly severe, particularly in offshore well applications. Thus, specifications for offshore well installations now frequently require that such seals be effective against internal pressures at the wellhead of 15,000 p.s.i., and that capability frequently must be achieved under conditions of remote installation of the two concentric members and of the seal device itself. Particularly in the offshore well industry, there has been a trend away from elastomeric sealing elements toward metal-to-metal seals, with the metal-to-metal seal being viewed as a more dependable device over a long time period than seals depending upon elastomeric materials. However, conventional metal-to-metal sealing elements, such as the metal lip seals, depend upon elastic deformation of the sealing element, first mechanically and then in response to the pressure against which the seal is to act, and such devices have not always been dependably successful. Further, such devices must have a shape allowing the seal device to be elastically deformed under mechanical pressure applied by the parts being sealed, and this requirement has in some cases resulted in damage to the seal element, or the surfaces against which that element is to act, during remote installation of the seal element. There has thus been a continuing need for improvement, particularly when a metal-to-metal sealing action is needed.

OBJECTS OF THE INVENTION

It is accordingly a general object of the invention to provide a method and apparatus which will better serve the requirements for sealing between concentric well members and between other concentric rigid members.

Another object is to provide such a method and apparatus in which the seal element is of such dimension and shape that the seal element does not come into engagement with a critical surface, such as the surface portion of a bore wall against which the seal is to act, before the seal element is in place and ready to be activated.

A further object is to devise such a method and apparatus making it possible to bring the seal element into sealing engagement as a result of plastic deformation of the seal element.

Yet another object is to provide such a method and apparatus which makes possible remote sealing across an annulus between two rigid members with sealing being accomplished solely by a plastically deformed metal element in true metal-to-metal sealing fashion.

SUMMARY OF THE INVENTION

According to method embodiments of the invention, concentrically opposed surface portions are provided on the two rigid members, at least one of these surface portions being generally frustoconical and tapering longitudinally of the rigid members so that the two surface portions define an annular space tapering from a first end of larger radial width to a second end of smaller radial width. Into this space is preliminarily inserted a sealing ring which has a radial thickness which tapers axially. The direction of taper and the dimensions of the ring are such that, when preliminarily inserted, at least a leading portion of the ring substantially bridges the space between the annular surface portions of the rigid members but does not provide an effective seal. At least the leading portion of the sealing ring is of a material having good plastic deformation properties, low carbon steel in the annealed or normalized state being typical of such materials when a metal-to-metal seal is desired. While the two concentric rigid members are held against axial displacement, a large pressure is applied to the end of the ring which is of larger radial thickness, the pressure being uniformly distributed over the annular extent of the ring and directed axially toward the end of smaller radial thickness, the effect of the applied pressure being to force the ring to move further into the annular space in wedging fashion and to be plastically-deformed, as a result of the further movement relative to the rigid members and the tapering nature of the annular space, so that the plastically-deformed portion of the ring is forced into fluid-tight sealing engagement with the concentrically opposed surface portions of the rigid members. The seal member is then locked to one of the rigid members to retain the ring in its sealing position.

In particularly advantageous embodiments, one of the concentrically opposed surface portions is interrupted by a transverse annular shoulder facing toward the end of the annular space which is of smaller radial width, providing in effect an annular recess into which the material of the seal ring flows during movement of the ring to its final position. Thus, with the one of the concentrically opposed surface portions carried by the inner rigid member being frustoconical and uninterrupted, the outer surface portion can include a first right cylindrical portion of smaller diameter joined by the transverse shoulder to a second right cylindrical portion of slightly larger diameter.

Though application of pressure to force the seal ring to its final position and cause the desired plastic deformation can be accomplished in various ways, it is advantageous to so construct the seal ring that it can act as a piston, and to apply fluid under pressure to generate the necessary force for moving the seal ring relative to the concentric rigid members.

IDENTIFICATION OF THE DRAWINGS

DETAILED DESCRIPTION OF THE INVENTION

Figure 1:
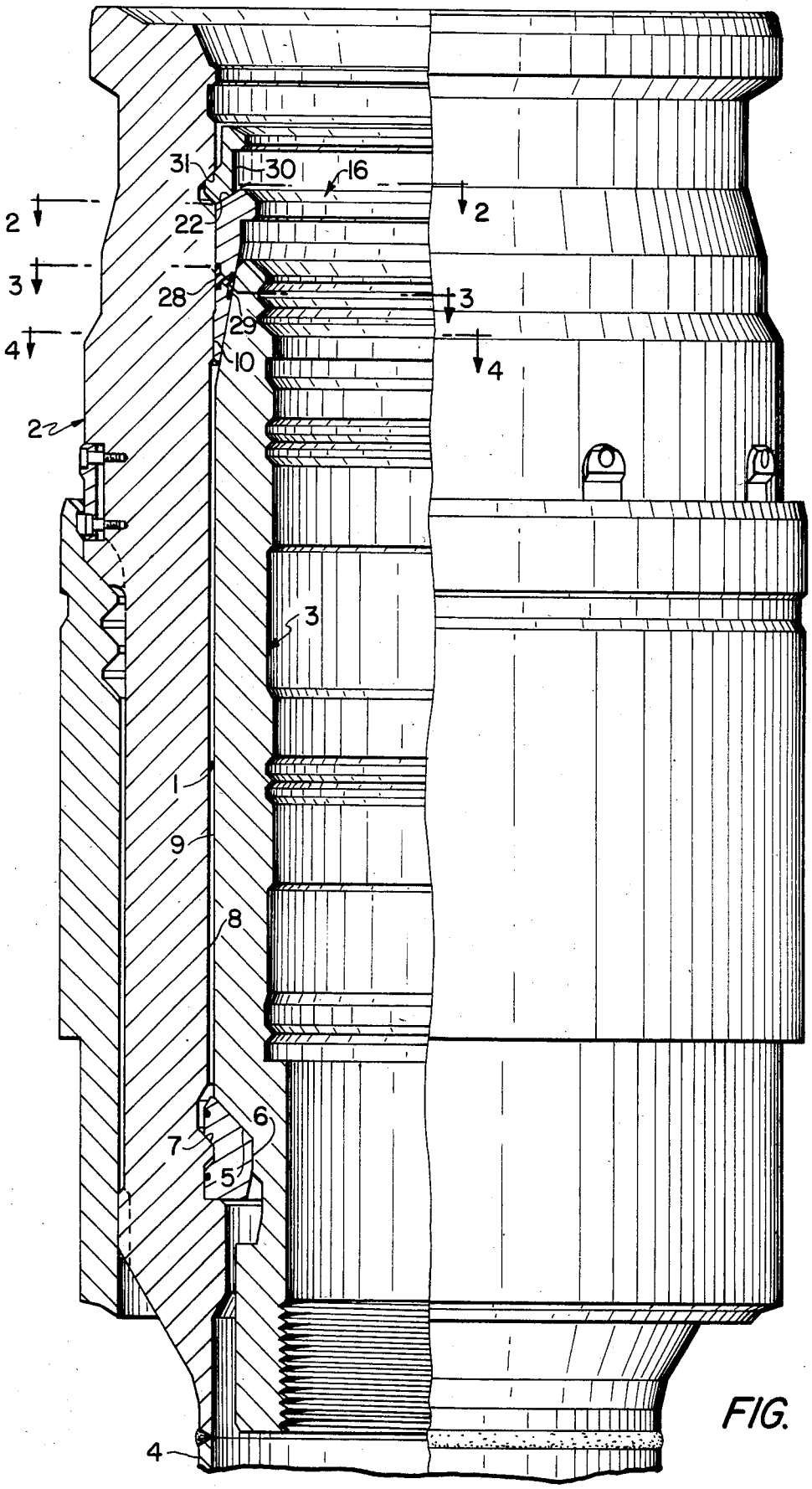
FIG. 1 is a view, partly in vertical cross section and partly in side elevation, of an underwater well apparatus in which sealing across the annulus between a wellhead body and a casing hanger has been accomplished according to one embodiment of the invention.
Figure 2:
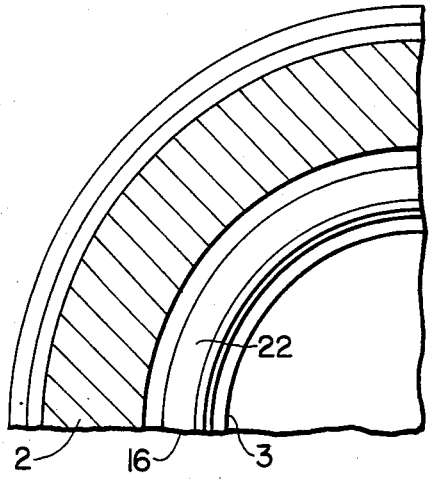
FIGS. 2–4 are fragmentary cross-sectional views taken generally on lines 2—2, 3—3 and 4—4, FIG. 1, respectively.

FIG. 1 illustrates one embodiment of the invention as applied to sealing across the annulus 1 between a wellhead lower body 2 and a casing hanger 3. The apparatus shown is part of a subsea well installation, with body 2 being secured to the upper end of an outer casing string 4, hanger 3 being supported on body 2 by a shoulder 5 seated on an annular series of segments 6 seated on a shoulder 7 on body 2, and with annulus 1 being in communication, in any suitable fashion, with the annulus between outer casing 4 and the casing (not shown) suspended from hanger 3.

Figure 5:
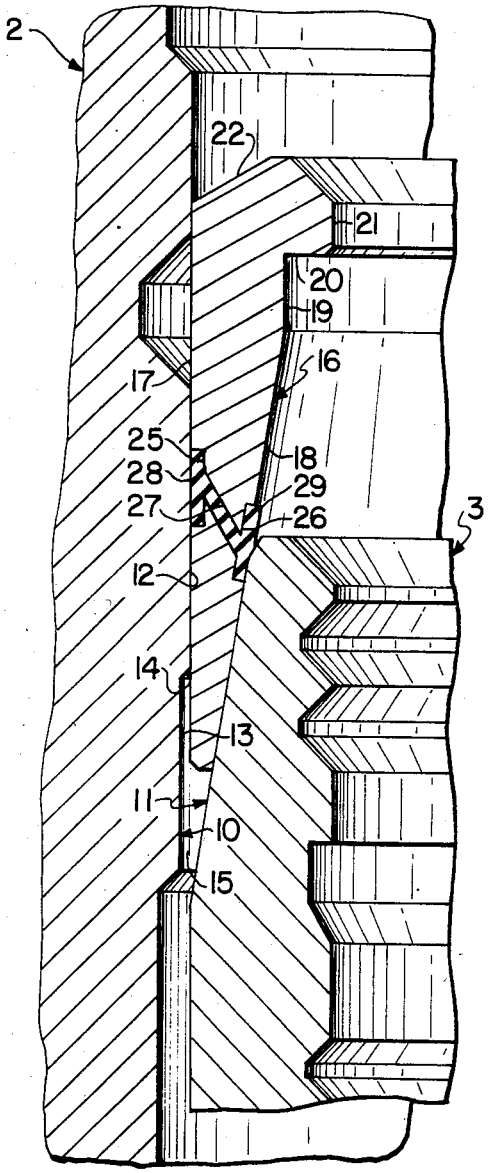
FIG. 5 is a fragmentary vertical cross-sectional view, enlarged with respect to FIG. 1, showing the seal ring preliminarily inserted into the annular space between concentrically opposed surface portions of the wellhead body and casing hanger.

Comparing FIGS. 1 and 5, it will be seen that most of annulus 1 is defined by the main bore wall 8 of body 2 and the main outer surface 9 of hanger 3, both of which are right cylindrical, with surface 9 being spaced inwardly from and concentric with wall 8. However, at the upper end of hanger 3, annulus 1 is defined by two concentrically opposed surface portions 10 and 11. Surface portion 10 is presented as part of the through bore of body 2 and includes an upper right cylindrical portion 12 and a lower right cylindrical portion 13, the latter being of slightly larger diameter than the former, portions 12 and 13 being joined by a transverse annular downwardly facing shoulder 14. Surface portion 11 forms part of the outer surface of hanger 3 and is uninterrupted and frustoconical, tapering upwardly and inwardly at a small angle. Thus, when hanger 3 has been landed on segments 6, surface portions 10 and 11 coact to define an annular space, indicated generally at 15, FIG. 5, which tapers from a larger radial width, at the top of hanger 3, to a smaller radial width, at the lower end of right cylindrical portion 13.

With hanger 3 and body 2 related in the manner just described, a seal ring, indicated generally at 16, is preliminarily inserted downwardly into space 15, this operation being carried out conventionally by use of a handling tool and handling string (not shown). Seal ring 16 includes an integral main body of material capable of exhibiting a significant plastic deformation, low carbon steel in the annealed or normalized state being a typical suitable material. In its initial form ring 16 has a right cylindrical outer surface 17 and an inner surface including a main frustoconical portion 18, tapering upwardly and inwardly at the same angle as surface portion 11 of hanger 3. The inner surface of the seal ring also includes a short right cylindrical portion 19 which extends upwardly from frustoconical portion 18 and joins a transverse annular downwardly directed shoulder 20. Shoulder 20 joins a short right cylindrical inner surface 21 which extends to the upper end face of the ring. The upper end face includes an outer frustoconical portion 22 which tapers upwardly and inwardly for a purpose hereinafter described.

Figure 3:
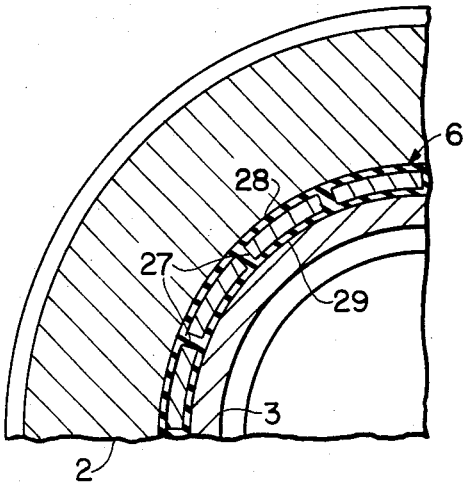
Figure 4:
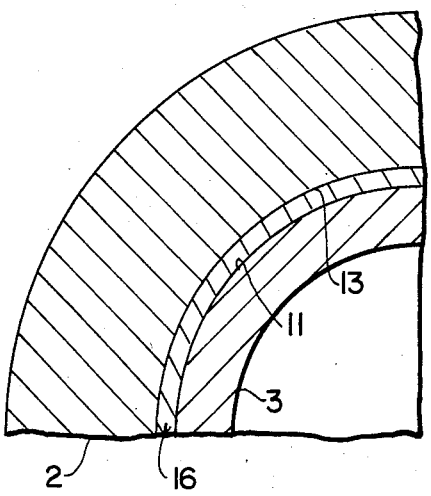

In a location spaced from the lower end of the ring by a distance greater than the axial length of surface portion 13, outer surface 17 of the seal ring is interrupted by a transverse annular outwardly opening groove 25, FIG. 5. In a location significantly below that of groove 25, frustoconical inner surface portion 18 is interrupted by a transverse annular inwardly opening groove 26. Grooves 25 and 26 are interconnected by a circularly spaced series of bores 27, FIGS. 3 and 5. Grooves 25 and 26 and bores 27 accommodate an integral body of elastomeric material constituting both an annular outer elastomeric seal body 28 and an inner annular elastomeric seal body 29, seal bodies 28, 29 being interconnected by elastic material within bores 27. With the elastomeric material in its relaxed and undistorted state, body 28 completely fills groove 25 and body 29 not only completely fills groove 26 but also projects slightly inwardly beyond surface portion 18. Accordingly, as ring 16 is preliminarily inserted downwardly into space 15, seal body 29 is progressively compressed as a result of engagement with surface portion 11. Such compression causes elastomeric material to flow outwardly through bores 27 to increase the volume of elastomeric material in groove 25. As a result, the elastomeric material preliminarily seals between ring 16 and both surface portions 10 and 11 as soon as seal body 29 comes into good overlapping relation with the upper end of surface portion 11. Thus, preliminarily inserted as seen in FIG. 5, seal ring 16 is capable of action as a piston when pressure fluid is introduced within body 2.

Figure 6:
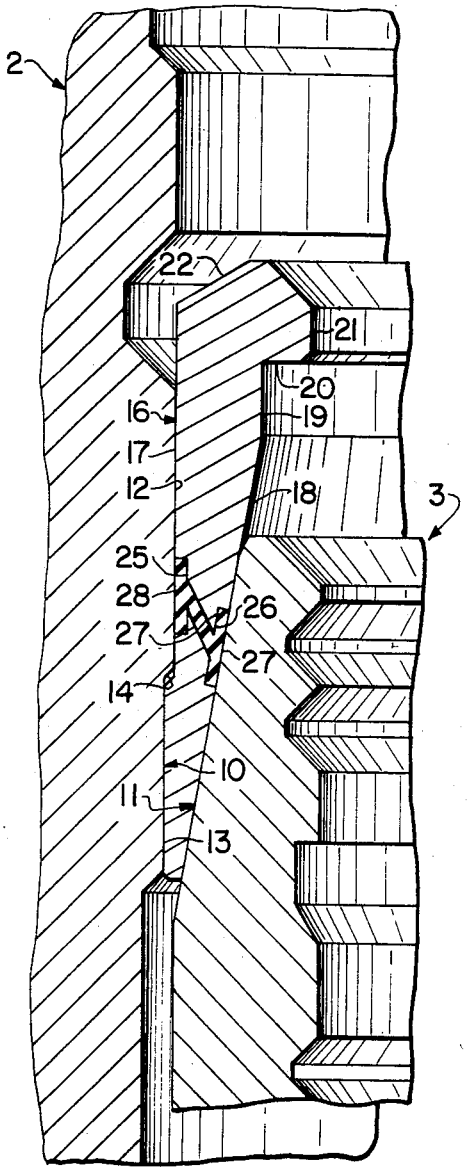
FIG. 6 is a view similar to FIG. 5 but showing the seal ring after reaching its final position, with plastic deformation having occurred.

As will be understood by those skilled in the well art, it is conventional to introduce pressure fluid into the wellhead, after seals have been installed, in order to test the seal or seals. According to the invention, this conventional practice is now employed to apply to the upper end portion of the preliminarily inserted seal ring 16 a large fluid pressure acting downwardly on and uniformly distributed over the annular extent of the ring. Since body 2 is rigidly supported, and hanger 3 is in turn rigidly supported on body 2 by shoulders 5 and 7 and segments 6, there can be no axial displacement of body 2 and hanger 3, and the effect of the applied fluid pressure is thus to force ring 16 downwardly further into annular space 15, in the manner seen by comparing FIGS. 5 and 6. At the start of such further displacement, the portion of ring 16 below elastomeric seal bodies 28, 29 substantially completely fills the annular space between surface portions 10 and 11 but does not seal therewith in acceptable fashion. However, since surface portions 10 and 11 converge downwardly, the remaining lower portion of annular space 15 is of inadequate width to accommodate the lower portion of ring 16 without deformation of the ring. Since the force applied downwardly on ring 16 by the pressure fluid is large in the context of the ability of the relatively ductile metal of ring 16 to resist plastic deformation, progressive movement of the ring downwardly into space 15 causes plastic deformation of the ring to such an extent that the ring completely fills the space between surface portions 13 and 11. Thus, metal of ring 16 in effect flows around shoulder 14, and as ring 16 reaches the final position seen in FIGS. 1 and 6, the lower portion of the ring has been forced into metal-to-metal sealing engagement not only with surface portion 11 but also with surface portion 13.

Installation of the seal can then be completed by installing a split locking ring 30, FIG. 1, between end face portion 22 of ring 16 and the upper side wall 31 of a transverse annular inwardly opening locking groove provided in body 2, ring 16 thus being locked against upward movement relative to body 2. Installation of locking ring 30 is accomplished by use of a conventional handling tool and string (not shown). With the locking ring installed as shown in FIG. 1, the combination of the locking ring and seal ring 16 serves to prevent upward movement of hanger 3 should excessive upwardly acting bore pressure occur.

Should need occur to retrieve seal ring 16, this can be accomplished by first removing locking ring 30 and then lowering a handling tool equipped to engage shoulder 20 of the seal ring and applying an upward strain on ring 16 adequate to deform the portion of ring 16 which is below shoulder 14.

Seal ring 16 extends as a complete, unbroken annulus which, at time of installation, is in an initial undistorted state such that the diameter of outer surface 17 of the ring is slightly smaller than the diameter of part 12 of surface portion 10. Part 12 of surface portion 12 is the smallest diameter to be traversed by ring 16 during its trip down for installation and the possibility of scoring or otherwise damaging outer surface 17 of the ring during the trip down is therefore minimized. Similarly, the diameter of part 13 of surface portion 10 is significantly larger than that of part 12, so that part 13, constituting the outer sealing surface in the final assembly, is protected from damage by tools and components passed through the wellhead before installation of the seal ring. It is to be noted that protection of the two active sealing surfaces 13 and 17 in this fashion is possible only because of the plastic deformation of the seal ring during the final stage of installation.

It is particularly advantageous to form ring 16 of a low carbon steel in the annealed or normalized condition. Thus, the steels identified by AISI numbers 1010, 1030 and 1040 are especially suitable. Austenitic steels, such as those of the AISI 300 series, in the annealed state are also suitable. Non-ferrous alloys, particularly the copper based and aluminum based alloys, can also be employed. Non-metallic materials, such as a composite of polymers with a combination of fillers with or without reinforcing fibers may be suitable for lower temperature and pressure applications. It will also be understood that only the portion of the seal ring which leads during insertion, such as the portion of ring 16 below the elastomeric seal bodies, need be of material capable of plastic deformation.

Figure 7:
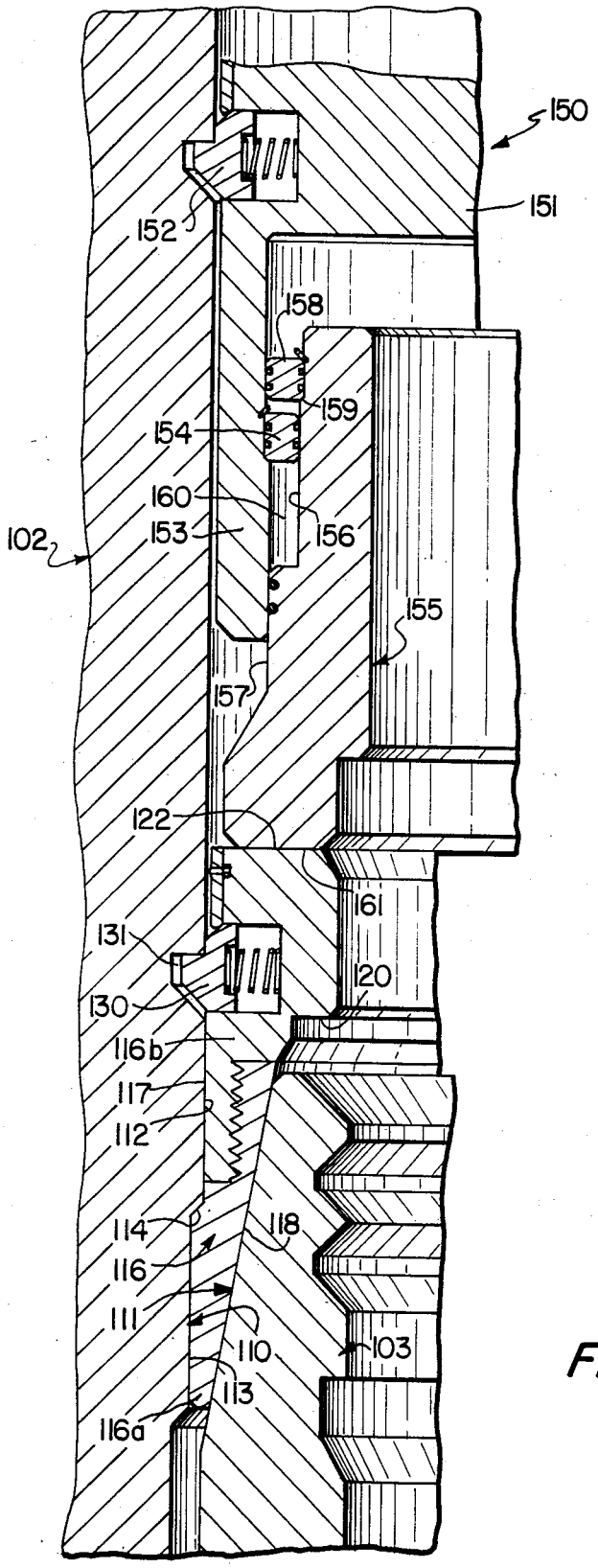
FIG. 7 is a view similar to FIG. 6 illustrating another embodiment in which the final stage of insertion of the seal ring is accomplished by a tool which is subsequently retrieved.

The Embodiment of FIG. 7

FIG. 7 illustrates an embodiment of the invention in which final insertion of the seal ring, to accomplish the necessary cold flow deformation, is accomplished by use of a tool rather than by introducing pressure fluid into the wellhead. Here, wellhead body 102 and casing hanger 103 again combine to define the annulus 101 to be sealed. The wellhead body again has a through bore and the wall of the through bore includes surface portion 110 which is opposed to surface portion 111 of the casing hanger after the hanger has been landed as described with reference to FIGS. 1–6. Surface portion 110 is identical to surface portion 10, FIGS. 1–6, and includes an upper right cylindrical part 112, a lower right cylindrical part 113 and a transverse annular shoulder 114 joining parts 112 and 113. Surface portion 111 is again frustoconical, tapering upwardly and inwardly.

In this embodiment, seal ring 116 is of the same general configuration as ring 16, FIGS. 1–6, but comprises a lower or leading portion **116*a* and an upper or trailing portion 116*b*, the two portions being rigidly interconnected in any suitable fashion. In the initial undistorted state of ring 116, the two portions 116*a*, 116*b* combine to present an outer surface 117 which is right cylindrical and of a diameter only slightly smaller than that of part 112 of surface portion 111, and a frustoconical inner surface 118 which tapers upwardly and inwardly at the same angle as does surface portion 111. Upper portion 116*b* of the seal ring has a transverse annular outwardly opening groove accommodating a circular series of arcuate latch segments 130 which are spring urged outwardly and can be constructed and arranged as described in detail in my U.S. Pat. No. 4,290,483. Body 102 is provided with a transverse annular inwardly opening locking groove 131 at the upper end of part 112 of surface portion 110, to receive segments 130 when the seal ring has been forced downwardly to its final active position. The upper end of portion 116*b* of the seal ring has a transverse annular downwardly facing shoulder 120, to cooperate with a handling and retrieving tool (not shown) and an upwardly directed flat transverse annular end face 122**.

Initial downward insertion of seal ring 116 into the annular space defined by surface portions 110 and 111 is accomplished with a handling string and tool (not shown) in the manner referred to with reference to FIGS. 1–6, leaving the ring in an initial position similar to that shown in FIG. 5, with portion **116*a* of the ring being as yet undeformed and with latch segments 130 still above groove 131 and bearing on the bore wall of the wellhead body. In this embodiment, downward force is applied to the seal ring to accomplish final insertion by the tool indicated generally at 150. Tool 150 includes a main body 151 which is lowered by a handling string (not shown) and latched against upward movement relative to body 102, as by segments 152 which are constructed and arranged as described in my U.S. Pat. No. 4,290,483 to coact with a locking groove presented by body 102. An annular skirt 153 depends from body 151 and has a stationary seal ring 154 secured to the inner surface thereof. Coacting with skirt 153 and seal ring 154 is an annular piston indicated generally at 155 and presenting an upper outer surface portion 156, spaced inwardly from the skirt and slidably embraced by ring 154, and a lower outer surface portion 157 which is slidably embraced by the inner surface of the skirt below ring 154. An additional seal ring 158 is secured to and embraces the upper end portion of the piston and is slidably embraced by the surrounding portion of the skirt. O-rings or other suitable seals are provided, as shown, so that skirt 153 and piston 155 coact to define an upper expansible chamber 159 and a lower expansible chamber 160, suitable ducting (not shown) being provided for supply of pressure fluid selectively of the two expansible chambers. Supply of pressure fluid to chamber 159 drives piston 155 upwardly relative to tool body 151. Supply of pressure fluid to chamber 160** drives the piston downwardly, to the position shown in FIG. 7.

The lower end of piston 155 has a flat transverse annular downwardly directed end face 161 dimensioned to come into flush engagement with upper end face 122 of ring 116 as the piston moves downwardly. The dimensions of ring 116 and piston 155 are such that, when ring 116 is in its preliminarily inserted position, end face 161 of the piston comes into engagement with upper end face 122 of the seal ring before the downward stroke of the piston has been completed. The total excursion of the piston is such that completion of the downward stroke of the piston forces the seal ring downwardly to the fully inserted position shown in FIG. 7 and thereby results in cold-flow distortion of the lower portion 116*a* of the seal ring to the condition shown, that portion of the seal ring thus being in metal-to-metal sealing engagement with both surface portion 111 and part 113 of surface portion 110.

What is claimed is:

1. The method for providing a fluid-tight seal across the annulus between two concentric rigid members in order to seal the annulus against large fluid pressures, comprising providing concentrically opposed surface portions on the rigid members, at least one of said surface portions being generally frustoconical and tapering longitudinally of the rigid members, whereby said surface portions define therebetween an elongated annular space which tapers from a first larger radial width to a second smaller radial width;

preliminarily inserting into said annular space a metal sealing ring which has a radical thickness which decreases axially of the ring, the direction of preliminary insertion being such that the end portion of the ring which is of smaller radial thickness enters the portion of said annular space which is of larger radial width and proceeds toward the portion of said annular space of smaller radial width, said concentrically opposed surface portions each including an elongated sealing surface which extends from the end of said annular space which is of smaller radial width toward the opposite end of said annular space, the length of said sealing surfaces being equal to a substantial portion of the axial length of the ring, the relative radial widths of the ring and said elongated annular space being such that, as the ring is preliminarily inserted, the ring is stopped by engagement with at least one of said concentrically opposed surface portions when the leading end of the ring is still a substantially distance from the end of said elongated annular space which is of smaller radial width, at least the leading portion of the sealing ring being of a metal capable of significant plastic deformation; and while restraining the two rigid members against axial displacement, applying to the end of the ring which is of larger radial thickness a large force directed axially of the ring toward the end of smaller radial thickness and uniformly distributed over the annular extent of the ring and thereby forcing the metal of at least the leading portion of the ring into the condition of plastic flow, with the ring then moving further into said annular space under the action of said large force until a substantial portion of the length of the ring is in fluid-tight sealing engagement with both of said sealing surfaces.

2. The method defined in claim 1, wherein one of said surface portions is interrupted by a transverse annular shoulder directed toward the end of said annular space which is of smaller radial width, the radial width of said annular space thus being increased adjacent said shoulder on the side of the shoulder directed toward the end of smaller radial width;

said step of applying force to said end of the ring causing the material of the ring to flow around said shoulder and to fill said portion of said annular space of increased width adjacent said shoulder.

3. The method defined in claim 2, wherein the one of said surface portions carried by the inner rigid member is frustoconical; and the one of said surface portions carried by the outer rigid member includes a first part which is right cylindrical and of smaller diameter and a second part which is right cylindrical and of larger diameter, said shoulder joining said first and second parts and said second part extending from said shoulder toward the end of said annular space of smaller radial width.

4. The method defined in claim 1, wherein the sealing ring is of low carbon steel in the annealed or normalized state.

5. The method defined in claim 1, wherein a portion of the sealing ring which trails during the step of inserting the ring into said annular space has means establishing preliminary seals between the ring and the opposed surface portions during the step of preliminarily inserting the sealing ring into said annular space; and the step of applying a large force to the sealing ring is accomplished by supplying fluid under pressure at the end of the ring of larger radial thickness.

6. The method defined in claim 1, wherein one of the two concentric rigid members is a wellhead body having an upright bore and the other of the two concentric rigid members is a hanger body disposed within the bore of the wellhead body, the one of said surface portions which is frustoconical being carried by the hanger body and tapering upwardly and inwardly, the other of said surface portions constituting part of the bore wall of the wellhead body;

said step of applying a large force to the ring is effective to force the ring downwardly and cause plastic deformation of a portion of the ring to bring the ring into sealing engagement with both said one surface portion and the lower part of said other surface portion.

7. The method defined in claim 6, wherein said lower part of said other surface portion is right cylindrical;

said other surface portion includes a right cylindrical upper part which is of smaller diameter than said lower part, there being a transverse annular downwardly facing shoulder joining said two parts; and said step of applying a large force to the ring is effective to cause such outward deformation of the ring as to bring the ring into engagement with said lower part below said shoulder.

8. In an apparatus of the type described, the combination of a first rigid member having a bore, the wall of the bore including an inwardly facing annular surface portion;

a second rigid member extending within said bore and having an outer surface spaced inwardly from said bore wall to provide an annulus between the first and second rigid members, said outer surface including an outwardly facing surface portion spaced inwardly from and concentric with said inwardly facing surface portion, at least one of said inwardly facing annular surface portion and said outwardly facing surface portion being generally frustoconical and tapering longitudinally of said rigid members, whereby said inwardly facing and outwardly facing surface portions combine to define an annular space which tapers from a first larger radial width to a second smaller radial width, one of said inwardly facing and outwardly facing surface portions being interrupted by a transverse annular shoulder directed toward the end of said annular space which is of smaller radial width, the radial width of said annular space thus being increased adjacent said shoulder on the side of the shoulder toward the end of smaller radial width; and a metal sealing ring disposed in said annular space and comprising a first end portion at the end of said annular space which is of smaller radial width, said first end portion of the sealing ring completely filling the corresponding portion of said annular space and having an outer surface in sealing engagement with the corresponding part of said inwardly facing surface portion of said first rigid member and an inner surface in sealing engagement with the corresponding part of said outwardly facing surface portion.

9. The combination defined in claim 8, wherein the sealing ring comprises a second end portion exposed at the corresponding end of said annular space; and the combination further comprises stop means carried by one of said rigid members and coacting with said second end portion of the sealing ring to restrain the sealing ring against axial movement in a direction toward the end of said annular space which is of larger radial width.

10. The combination defined in claim 9, wherein said outwardly facing surface portion is frustoconical; and said inwardly facing surface portion is right cylindrical.

11. The combination defined in claim 10, wherein said inwardly facing surface portion includes a first part which is of smaller diameter and is opposed to that portion of the outwardly facing surface portion adjacent the end of said annular space which is of larger radial width, and a second part which is of larger diameter and is opposed to that portion of the outwardly facing surface portion adjacent the end of said annular space which is of smaller radical width, said first and second parts of said inwardly facing surface portion being joined by said transverse annular shoulder.

12. The combination defined in claim 11, wherein the portion of the sealing ring which extends beyond said shoulder toward the end of said annular space which is of smaller radial width is of ductile metal and is in flush sealing engagement with said shoulder and portions of said inwardly facing surface and said outwardly facing surface extending from said shoulder toward the end of said annular space which is of smaller radial width.

13. The combination defined in claim 8, wherein the sealing ring is provided with inner and outer elastomeric seals in locations spaced from said first end portion of the ring toward said second end portion of the ring, the dimensions of the ring being such that, when the ring has been preliminarily inserted into said annular space, said elastomeric seals will respectively engage said outwardly facing surface portion and said inwardly facing surface portion, whereby fluid under pressure can be applied against said second end portion of the ring to drive the ring into said annular space.

14. The combination defined in claim 8, wherein the first rigid member includes a transverse annular inwardly opening locking groove spaced axially from said inwardly facing surface portion; and said lock means comprises a lock ring engaged in said groove and bearing against said second end portion of the ring.

15. In an underwater well installation, the combination of a rigidly supported outer body having an upright bore, said bore including an upper right cylindrical wall portion, a lower right cylindrical wall portion, and a transverse annular downwardly facing shoulder joining said wall portions;

a second body disposed within said bore and including a frustoconical outer surface portion concentric with and spaced inwardly from said cylindrical wall portions, said outer surface portion tapering upwardly and inwardly, whereby said cylindrical wall portions and said outer surface portion combine to define an annular space which tapers from an upper end of larger radial width to a lower end of smaller radial width, said second body being rigidly supported against downward movement relative to said outer body;

a metal seal ring disposed between said cylindrical wall portions and said outer surface portion, the radial thickness of said seal ring decreasing from the upper end to the lower end of the ring, a lower portion of said seal ring being plastically deformed into direct metal-to-metal sealing engagement with both said cylindrical wall portions and said outer surface portion; and stop means engaged with said seal ring and said outer body to restrain said seal ring against upward movement relative to said outer body.

* * * * *